US005733095A

United States Patent [19]

Palmer et al.

[11] Patent Number: 5,733,095

[45] Date of Patent: Mar. 31, 1998

[54] RIDE CONTROL SYSTEM

[75] Inventors: Marvin K. Palmer, Oswego; Victor A. Simkus, Elgin; Christopher P. Beaudin, Channahon; Bryan A. Vogt, Naperville, all of Ill.

[73] Assignee: Caterpillar Inc., Peoria, Ill.

[21] Appl. No.: 720,605

[22] Filed: Oct. 1, 1996

[51] Int. Cl.[6] ..... E02F 3/00

[52] U.S. Cl. ..... 414/685; 414/719; 60/413

[58] Field of Search ..... 414/680, 685, 414/719; 188/299, 314, 319; 60/413; 267/64.28

[56] References Cited

U.S. PATENT DOCUMENTS

| | | | |
|---|---|---|---|
| 3,949,892 | 4/1976 | Ohms | 214/674 |
| 4,046,270 | 9/1977 | Baron et al. | 414/719 X |
| 4,279,319 | 7/1981 | Joyce, Jr. | 180/12 |
| 4,317,593 | 3/1982 | Sarvela | 298/11 |
| 4,636,133 | 1/1987 | Hess | 414/715 |
| 4,734,006 | 3/1988 | Krob et al. | 414/719 |
| 5,116,188 | 5/1992 | Kurohashi et al. | 414/719 |
| 5,147,172 | 9/1992 | Hosseini | 414/719 |
| 5,195,864 | 3/1993 | Drake et al. | 414/699 |
| 5,245,826 | 9/1993 | Roth et al. | 60/413 |
| 5,520,499 | 5/1996 | Ufheil et al. | 414/685 |

*Primary Examiner*—Donald W. Underwood
*Attorney, Agent, or Firm*—Calvin E. Glastetter

[57] ABSTRACT

In machines having a bucket that is capable of carrying a load of material, it is well know that when the machine is traveling over rough terrain or encounters other obstacles the machine may bounce or the operator may be subjected to a jolt due to a change in force acting on the lift actuator. Accumulators have been connected to the loaded end of the lift actuator to cushion or dampen the sudden changes in the forces. When the machine is used without the accumulator connected to the lift actuator a pressure balancing valve mechanism is provided to maintain a pre-charge in the accumulator greater than or equal to the pressure in the head end of the lift actuator when the ride control comes on. In order to ensure that the pressure in the accumulator is always equal to the pressure in the head end of the lift actuator when ride control comes on, the accumulator is selectively connected to the implement pump or the reservoir. When in a manual mode the ride control is turned off when a tilt lever is moved to tilt the bucket, and when in a automatic mode the ride control is turned off when the machine is being operated below a predetermined ground speed.

12 Claims, 1 Drawing Sheet

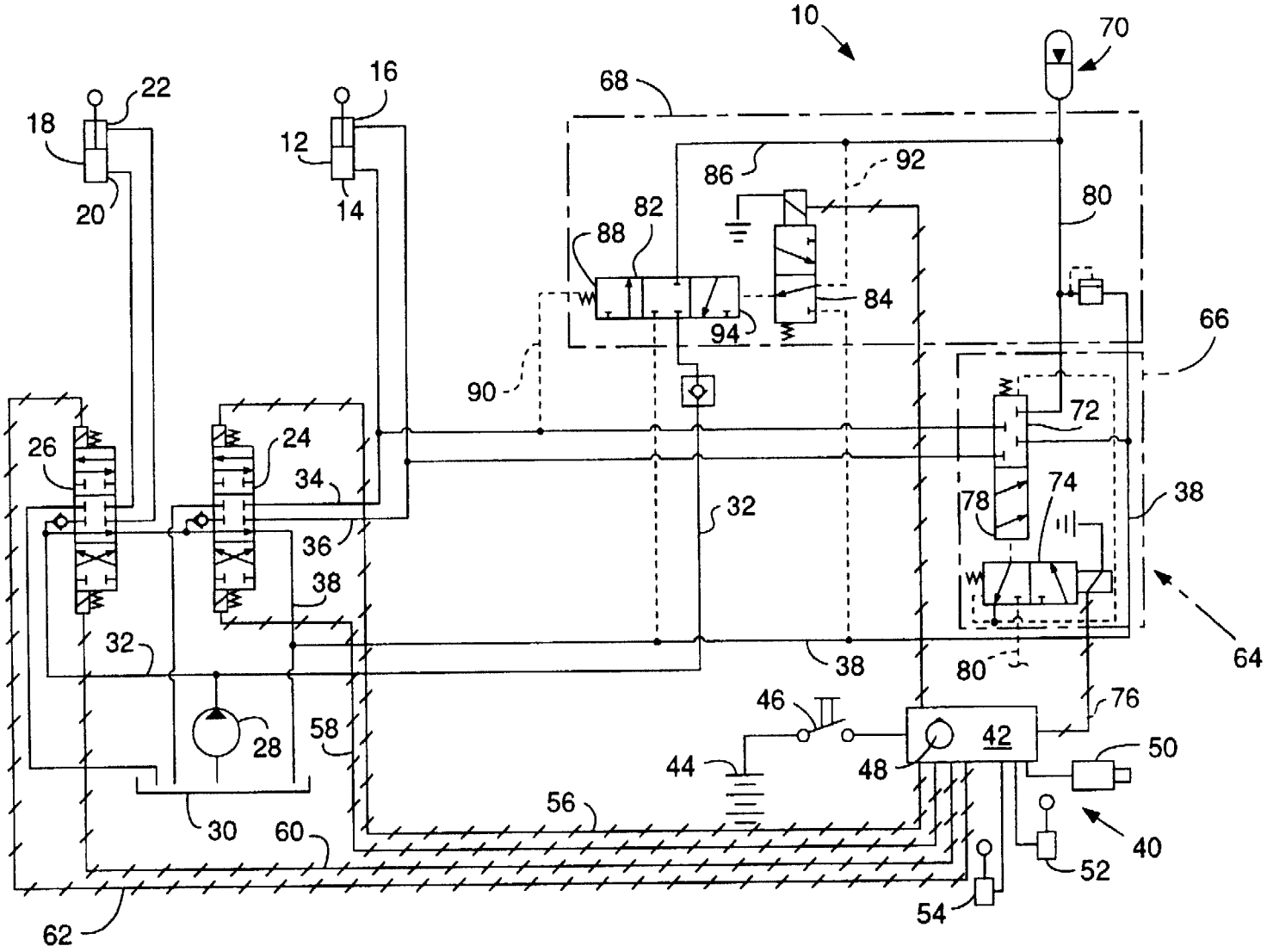
10
12
14
16
18
20
22
24
26
28
30
32
34
36
38
40
42
44
46
48
50
52
54
56
58
60
62
64
66
68
70
72
74
76
78
80
82
84
86
88
90
92
94

RIDE CONTROL SYSTEM

TECHNICAL FIELD

This invention relates generally to a ride control system and more particularly to a ride control system that has a valve to prevent communication between the lift actuator and the accumulator when the ride control system is turned off.

BACKGROUND ART

It is well known that when a machine, such as a wheel loader, with a loaded bucket is driven there is always the possibility that the machine will lope or bounce due to the weight of the loaded bucket reacting to the machine encountering rough terrain or other obstacles. In order to help reduce or eliminate this lope or bounce it is know to use accumulators that are selectively connected to the lift actuators. With the accumulator connected to the loaded end of the lift actuator pressure fluctuations in the actuators is absorbed thus offsetting changing forces acting on the tires of the machine. It is the changing forces acting on the tires of the machine that produces the lope or bounce. In order to maintain a pre-charge in the accumulator equal to the pressure in the loaded end of the actuators, it is known to connect the accumulator, during normal use, to the loaded end of the lift actuators by connecting a conduit therebetween. The conduit normally has a valve, having an orifice, that is selectably moved to dispose the orifice within the conduit when the machine is not operating in the ride control mode. It has been found that during some situations that the pressure in the accumulator may not be equal to the pressure in the loaded end of the lift actuator when the ride control is activated. The pressure not being equalized could allow the load to "drop" slightly or "jump" thus adding to the problem of machine bounce or subjecting the machine to a "jolt" Furthermore, it has been found that in previous systems, the ride control is always functional, once activated, even though operating conditions would be better if the ride control were turned off. Likewise, it has been found that machines having other circuits, such as bucket tilt circuits, operation of the tilt circuit may cause the lift actuator to "jerk or jump" when the bucket has reached the extreme dump or rackback positions.

The present invention is directed to overcoming one or more of the problems as set forth above.

DISCLOSURE OF THE INVENTION

In one aspect of the present invention, a ride control system is provided for use on a machine having a frame with a lift mechanism operative through an actuator to raise a bucket relative to the frame. The actuator has first and second ports operative to raise and lower the bucket in response to pressurized fluid being selectively directed to and from the respective ports thereof from a directional control valve that is connected to a reservoir. An accumulator arrangement is connected to the first port of the actuator. The ride control system comprises a source of pressurized fluid. A first valve mechanism is operatively disposed between the accumulator arrangement and the first port of the actuator. The first valve mechanism is moveable between a spring biased first position at which communication is blocked between the first port of the actuator and the accumulator arrangement and a second position at which open communication therethrough is permitted. A second valve mechanism is operatively disposed between the source of pressurized fluid and the accumulator. The second valve mechanism is spring centered to a first position at which communication therethrough is blocked, a second position at which communication is permitted between the source of fluid and the accumulator and a third position at which communication is controllably permitted from the accumulator to the reservoir. A controller is connected to the first valve mechanism and is operative to move the first valve mechanism from its first position to its second position in order to provide ride control and connected to the second valve mechanism to move the second valve mechanism to equalize the fluid pressure between the accumulator and the first port of the actuator.

BRIEF DESCRIPTION OF THE DRAWINGS

The drawing illustrates a diagrammatic representation of a machine control system incorporating an embodiment of the present invention.

BEST MODE FOR CARRYING OUT THE INVENTION

Referring to the drawing, a control system 10 is illustrated for use on a machine (not shown) having a lift and tilt mechanism for controlling movement of a bucket or the like. A first actuator, such as a lift actuator 12, having first and second ports 14,16 controls the raising and lowering of the bucket. A second actuator, such as a tilt actuator 18, having first and second ports 20,22 controls tilting the bucket forwardly (dump) or rearwardly (rackback).

The control system 10 further includes a first directional control valve 24 operative to control movement of the lift actuator 12, a second directional control valve 26 operative to control movement of the tilt actuator 18, a source of pressurized fluid such as a pump 28, and a reservoir 30 that serves as the source of fluid for the pump 28 and as a container for the fluid returned from the first and second actuators 12,18. A conduit 32 directs fluid from the pump 28 to second and first directional control valves 26,24. A conduit 34 directs fluid from the first directional control valve 24 to the first port 14 of the actuator 12 and a conduit 36 directs fluid from the first directional control valve 24 to the second port 16 of the actuator 12. A conduit 38 directs fluid from the first and second directional control valves 24, 26 to the reservoir 30.

The control system 10 also includes a control arrangement 40 having a controller such as a microprocessor 42, a source of electrical energy 44, a switch 46 for turning the ride control on or off, a selector switch 48 moveable between automatic and manual modes, and a ground speed sensor 50 that is operative to sense the speed of the machine relative to the ground and direct a signal representative thereof to the controller 42. A lift control lever 52 directs a signal indicating a desired lift movement to the controller 42. A tilt control lever 54 directs a signal indicating a desired tilt movement to the controller 42. In the automatic mode the ride control will be turned on when the machine is traveling above a predetermined speed and is turned off when the machine is traveling below the predetermined speed. In the manual mode the ride control is not affected by the speed of the machine, however when the controller 42 senses that the tilt lever 54 is being moved to dump the bucket the ride control is turned off. The controller 42 controls movement of each of the first and second directional control valves 24,26 dependent on the movement of the control levers 52,54 in a well known manner. The controller 42 is operatively connected by respective wires 56,58,60,62 to actuators at opposite ends of the first and second directional control valves 24,26 in a conventional manner. It is recognized that pilot actuated vales could be used to control movement of the respective first and second directional control valves without departing from the present invention.

A ride control arrangement 64 is provided and includes a first valve mechanism 66, a second valve mechanism 68 and an accumulator arrangement 70. The first valve mechanism 66 includes a first valve 72 for selectively controlling fluid flow from the lift actuator 12 to the accumulator arrangement 70 or the reservoir 30, and a second valve 74 controlled by the controller 42 for moving the first valve 72 in order to provide ride control. The first valve 72 is moveable between a spring biased first position at which fluid communication from the conduits 34,36 is blocked and a second position at which communication therethrough is permitted. In its second position the first valve 72 allows fluid from the conduit 34 to communicate with the accumulator arrangement 70 through a conduit 80 and fluid from the conduit 36 is returned to the reservoir 30 by the conduit 38. The second valve 74 is moveable between a spring biased first position and a electrically controlled second position. The second valve 74 is electrically connected to the controller 42 by a wire 76 and is moveable to its second position responsive to receipt of a signal from the controller 42. When the second valve 74 is in its first position fluid communication from an end 78, opposite the spring, of the first valve 72 is opened to the reservoir 30 so that first valve 72 is biased to its first position. When the second valve 74 is in its second position communication from a pilot pressure source, not shown, in a conduit 80 is permitted therethrough to act on the end 78 of the first valve 72, thus moving the first valve to its second position to provide ride control. The second valve mechanism 68 includes a first valve 82 and a second valve 84. The first valve 82 is a three position spring centered balancing valve. The first valve 82 has a first position at communication therethrough is blocked, a second position at which communication is permitted between the pump 28, through the conduit 32, and the accumulator 70 through a conduit 86 and a third position at which the conduit 86 is connected to the conduit 38 for return to the reservoir 30. A pilot pressure is directed to a first end 88 of the first valve 82 by a conduit 90. The second valve 84 is moveable between a spring biased first position at which communication is permitted, through a conduit 92, between the conduit 86 and a second end 94 of the of the first valve 82 and a electrically actuated second position at which communication is permitted from the second end 94 of the first valve 82 to the reservoir 30. The second valve 84 is connected to the controller 42 by a wire 76 and is moveable to its second position responsive to a receipt of a signal from the controller 42.

The accumulator arrangement 70 is provided and selectively connected to the first port 14 of the lift actuator 12 by conduits 80,34, valve mechanism 66 and also selectively connected to the pump 28 by conduits 86,32, valve mechanism 68. Even though only one accumulator is shown and described, more than one could be used and connected in parallel without departing from the scope of the invention. The accumulator 70 is operatively connected to the lift actuator 12 so that bounce of the lift arrangement can be absorbed when the ride control is turned on and also selectively connected to the pump 28 or reservoir 30 so that it maintains the same pressure level as the pressure level in the first port 14 of the lift actuator.

It is recognized that various forms of the subject control system 10 could be utilized without departing from the scope of the invention. For example, even though each of the valves 24,26,74,84 are illustrated and described as being electrically actuated by a signal from the controller 42, they each could be actuated manually, hydraulically or by other forms such as air. Likewise, even though the source of pressurized fluid 28 is from the implement circuit, the fluid source could be from an independent pump or from a steering circuit or any other circuit in the system capable of producing the pressure needed to charge the accumulator to the level of pressure in the first port 14 of the lift actuator.

Industrial Applicability

During loading of the bucket, the operator would not want the ride control turned on in order to have positive control over the stiffness of the lift actuator 12 while filling the bucket. After the bucket is filled and raised to the desired position for travel, the first directional control valve 24 is returned to its centered position. As is well known, when the first directional control valve 24 is in its centered position and communication through the valves 72,82 is blocked, the first and second ports 14,16 of the lift actuator 12 are blocked from the pump 28 and the reservoir 30. Therefore, the first actuator 12 is hydraulically locked and cannot move. It is recognized that any leakage between the first and second ports 14,16 across the internal mechanism could allow a very slight movement. However, in the present description, slight amounts of leakage are being ignored.

When the machine is turned on and the ride control is not engaged, it is necessary to ensure that the pre-charge in the accumulator 70 is equal or greater than to the pressure in the first port 14 of the lift actuator 12. In order to ensure that the pressure in the accumulator 70 is at the proper level, the controller 42 directs a signal to the second valve 84 of the second valve mechanism 68 moving it to its second position. In the second position, the end 94 of the first valve 82 is connected to the reservoir allowing the pressure in pilot line 90 to move the first valve 82 to its second position. In the second position, the pump 28 through the supply conduit 32 is connected to the conduit 86 to charge the accumulator 70 to the pressure greater than or equal to the pressure in the first port 14 of the lift actuator. Consequently, the pre-charge in the accumulator 70 is always maintained equal to or greater than the pressure in the first port 14 when ride control is not turned on.

In the operation of the ride control system 64, the ride control is turned on by engaging the switch 46. It is recognized that other forms of engaging the ride control could be utilized. Once the switch 46 is turned on, the controller 42 first determines is the selector 48 is in the manual mode or the automatic mode and also disengages the second valve 84 allowing the valve 84 to move to its first position at which pressure is directed to the second end 94 of the valve 82 to balance the system. If the selector is in the automatic mode, the controller 42 first determines if the speed of the machine is above the predetermined speed level, if the speed criteria is satisfied, then after a predetermined delay to ensure pressure balancing, the controller 42 directs a signal to the second valve 74 of the first valve mechanism 66 moving it to its second position. In the second position pressure in conduit 80 is connected to the end 78 of the valve 72 moving the valve 72 to its second position to connect the first port 14 of the lift actuator to the accumulator 70. With the valve 72 in its second position any movement of the bucket is cushioned by flow from the first port being directed to the accumulator 70. Consequently, the force of the load is not transferred to the frame of the machine to cause a "jolt" thereto and subsequently to the wheels which would cause the machine to bounce. Likewise, when the ride control is turned on, there is no "sag" or "jerk" of the lift actuator 12 since the pressure level in the first port 14 is the same as the pressure in the accumulator 70.

If the ground speed of the machine drops below the predetermined level as sensed by the sensor 50, the controller automatically terminates the signal to the valve 74 and directs a signal to the valve 84 to return it to its second position to maintain the pre-charge in the accumulator at a pressure greater than or equal to the pressure in the first port 14 of the lift actuator 12. Terminating the signal to the valve 74 will allow the valve 72 to move to its first position at which communication therethrough is blocked thus eliminating "sag or spongy" lift arms while loading. Once the speed increases above the predetermined speed level, the controller 42 directs the signal to the valve 74 and terminates the signal to the valve 84 to re-activate the ride control.

When the ride control is on and active, any efforts by the operator to move the bucket to one of its extreme positions automatically inhibits any tendency for the lift actuator 12 to "jump" or raise since the pressure between the first port 14 and the accumulator is equalized.

If the selector 48 is in the manual mode the ride control is not affected by the speed of the machine, however when the tilt lever 54 is moved to dump the bucket the controller 42 directs a signal to the second directional control valve 26 to initiate dump and after a predetermined delay the controller 42 directs a signal to the valve 74 to turn off the ride control.

When the system 10 is turned off and the signal to the valve 84 is terminated, the valve will move to its first position directing the accumulator to maintain the pressure to the second end of the valve 82, moving the valve 82 to its third position thus allowing the accumulator to maintain pressure equal to the pressure in the first port 14 of the actuator 12.

From a review of the above, it should be apparent that the ride control system 64 controls "jolts" subjected to machine and bouncing of the machine by the machine traveling over rough terrain. Likewise, the ride control system controls the tendency of the lift actuator 12 to "sag" or "jerk" The subject invention ensures that a pre-charge pressure in the accumulator is equal to the pressure in the first port 14 of the lift actuator 12 when the ride control valve 74 turns on. The system provides for a ride control system that isolates the accumulator 70 from the lift actuator 12 when the ride control is turned off.

Other aspects, objectives and advantages of the invention can be obtained from a study of the drawing, the disclosure and the appended claims.

We claim:

1. A ride control system adapted for use on a machine having a frame with a lift mechanism operative through an actuator to raise a bucket relative to the frame, the actuator having first and second ports operative to raise and lower the bucket in response to pressurized fluid being selectively directed to and from the respective ports thereof from a directional control valve that is connected to a reservoir, and an accumulator arrangement connected to the first port of the actuator, the ride control system comprising:

a source of pressurized fluid;

a first valve mechanism operatively disposable between the accumulator arrangement and the first port of the actuator, the first valve mechanism being moveable between a spring biased first position at which communication is blocked between the first port of the actuator and the accumulator arrangement and a second position at which open communication therethrough is permitted;

a second valve mechanism operatively disposable between the source of pressurized fluid and the accumulator, the second valve mechanism being spring centered to a first position at which communication therethrough is blocked, a second position at which communication is permitted between the source of fluid and the accumulator and a third position at which communication is controllably permitted from the accumulator to the reservoir; and a controller connected to the first valve mechanism and selectively operative to move the first valve mechanism from its first position to its second position in order to provide ride control and connected to the second valve mechanism and selectively operative to move the second valve mechanism to equalize the fluid pressure between the accumulator and the first port of the actuator.

2. The ride control system of claim 1 wherein the source of pressurized fluid is an implement pump for raising and lowering the bucket and maintaining a balanced pressure between the accumulator and the actuator when the first valve mechanism is in its first position.

3. The ride control system of claim 1 wherein the first valve mechanism includes a first valve for selectively controlling communication between the actuator and the accumulator and a second valve controlled by the controller for moving the first valve in order to provide ride control.

4. The ride control system of claim 3 wherein the second valve is moveable between a spring biased first position at which communication is permitted from the first valve to the reservoir and a solenoid controlled second position at which communication is permitted from a pilot pressure to the first valve to move the first valve from its first position to its second position to provide ride control.

5. The ride control system of claim 4 wherein the second valve is moveable to its second position responsive to receipt of a signal from the controller.

6. The ride control system of claim 1 wherein the second valve mechanism includes a first valve for selectively controlling communication between the fluid power source and the accumulator and a second valve controlled by the controller for moving the first valve in order to control pressure within the accumulator.

7. The ride control system of claim 6 wherein the first valve is moveable from a spring centered first position at which communication therethrough is blocked, a pilot operated second position at which communication is permitted between the fluid source and the accumulator and a pilot operated third position at which communication is permitted between the accumulator and the reservoir.

8. The ride control system of claim 7 wherein the second valve is moveable between a spring biased first position at which communication is permitted from the accumulator to the first valve to move the first valve to its third position and a solenoid actuated second position at which communication is permitted from the first valve to the reservoir to move the first valve to its first and second positions.

9. The ride control system of claim 8 wherein the second valve is moveable to its second position responsive to receipt of a signal from the controller.

10. The ride control system of claim 1 including a ground speed sensor operative when the ride control system is in the automatic mode to sense the speed of the machine relative to the ground and deliver a signal representative thereof to the controller, the controller sends the signal to the first valve mechanism to turn off the ride control system in the event the speed of the machine drops below a predetermined speed level and turn on the ride control system in the event the speed is above the predetermined speed level.

11. The ride control system of claim 1 wherein the machine is adapted to include a tilt mechanism having a tilt actuator with first and second ports, the tilt actuator being operative to tilt the bucket forwardly and rearwardly by receiving fluid through a second directional control valve from the source of pressurized fluid.

12. The ride control system of claim 11 wherein the ride control system includes the controller having a manual mode which turns off the ride control when the second directional control valve is moved to dump the bucket.

* * * * *